US011805356B2

(12) United States Patent
Mackiewicz et al.

(10) Patent No.: US 11,805,356 B2
(45) Date of Patent: Oct. 31, 2023

(54) SYSTEM AND METHOD FOR CUSTOMIZING AN APPEARANCE OF EARBUDS

(71) Applicant: Harman International Industries, Incorporated, Stamford, CT (US)

(72) Inventors: Damian Mackiewicz, Long Island City, NY (US); Alexander Efimov, Munich (DE); Amin Einakian, Birmingham, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 126 days.

(21) Appl. No.: 17/674,654

(22) Filed: Feb. 17, 2022

(65) Prior Publication Data

US 2022/0272435 A1 Aug. 25, 2022

Related U.S. Application Data

(60) Provisional application No. 63/151,522, filed on Feb. 19, 2021.

(51) Int. Cl.
*H04R 25/00* (2006.01)
*H04R 1/10* (2006.01)

(52) U.S. Cl.
CPC ..... *H04R 1/1091* (2013.01); *H04R 1/1016* (2013.01); *H04R 1/1041* (2013.01); *H04R 2420/07* (2013.01)

(58) Field of Classification Search
CPC ... H04R 1/1091; H04R 1/1016; H04R 1/1041
See application file for complete search history.

(56) References Cited

U.S. PATENT DOCUMENTS

2014/0036127 A1* 2/2014 Pong ..... H04N 23/66 348/333.01
2016/0216943 A1* 7/2016 Welti ..... G06F 3/0488

FOREIGN PATENT DOCUMENTS

KR 20110103041 A 9/2011

* cited by examiner

*Primary Examiner* — Simon King
(74) *Attorney, Agent, or Firm* — Angela M. Brunetti

(57) ABSTRACT

A system and method setting an appearance of an earbud having a display attached to an outward facing surface of a support structure. The display has a curved edge having a perimeter that matches a perimeter of the support structure, the curved edge of the display screen conceals the support structure making only the display visible.

15 Claims, 5 Drawing Sheets

FIG. 3A
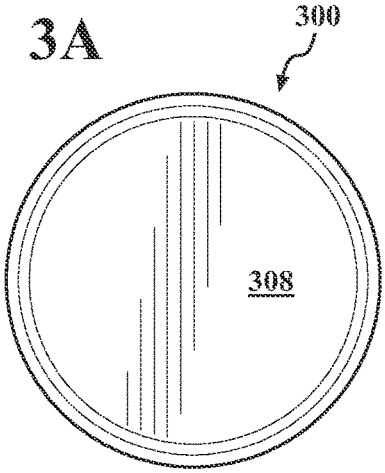
FIG. 3B
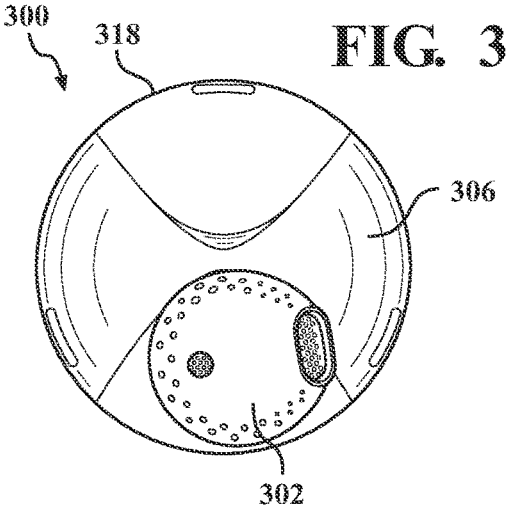
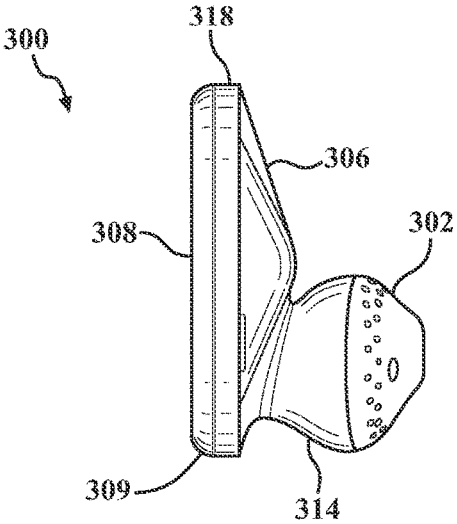
FIG. 3C
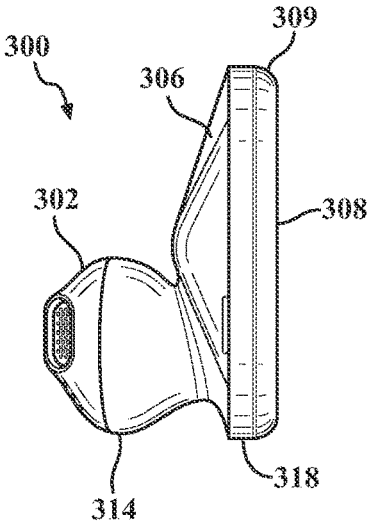
FIG. 3D
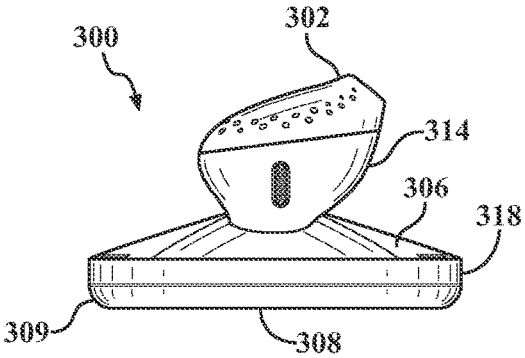
FIG. 3E
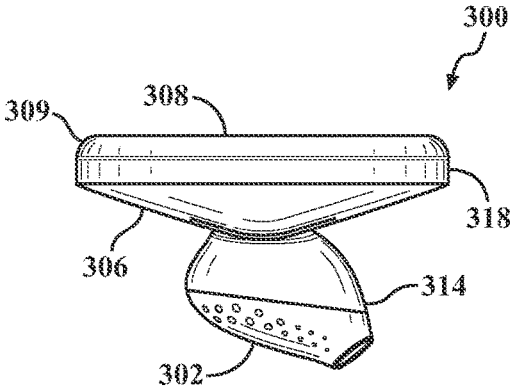
FIG. 3F

SYSTEM AND METHOD FOR CUSTOMIZING AN APPEARANCE OF EARBUDS

CROSS REFERENCE

This application claims the benefit of U.S. Provisional Application Ser. No. 63/151,522, filed Feb. 19, 2021, the disclosure of which is incorporated in its entirety by reference.

TECHNICAL FIELD

The present disclosure relates to earbuds and more particularly to a system and method for customizing an appearance of earbuds.

BACKGROUND

True wireless earbuds have an exterior finish that is a single color. A brand may manufacture several earbuds with fixed color/appearance options from which a user may choose at the time they purchase the earbuds. However, because the appearance is fixed, the user must choose one color to buy, or must buy multiple pairs to have multiple options for the appearance of the earbud. When faced with the choice, the user will typically make a safe chose, and go for a basic, standard color such as black or white. The safe choice may not necessarily be a true reflection of the user's style and is merely just a selection the settle on from the set of pre-defined options.

Another consideration is the difficulty manufacturers have in anticipating the colors/style consumers demand in marketplace. If their predictions are not an accurate reflection of mass market preferences, there is a risk that the product may not have success in the marketplace. If consumer tastes and expectations change, manufacturers are limited to what actions they may take to adjust their products to reflect consumer preferences.

There is a need for system and method that allows a consumer to customize and personalize earbud appearance in real-time using unlimited options.

SUMMARY

An earbud having a display having a curved edge that matches a predefined perimeter of its support structure. The curved edge of the display conceals the support structure of the housing making only the display visible. The display is customizable by toggling through a plurality of appearance options, selecting an appearance option for the display from the plurality of appearance options, and displaying the selected appearance option.

DESCRIPTION OF DRAWINGS

FIG. 3A is a top view of an earbud;

FIG. 3B is a bottom view of an earbud;

FIG. 3C is a side view of an earbud;

FIG. 3D is a side view of an earbud;

FIG. 3E is a side view of an earbud;

FIG. 3F is a side view of an earbud;

Elements and steps in the figures are illustrated for simplicity and clarity and have not necessarily been rendered according to any sequence. For example, steps that may be performed concurrently or in different order are illustrated in the figures to help to improve understanding of embodiments of the present disclosure.

DETAILED DESCRIPTION

While various aspects of the present disclosure are described with reference to one or more embodiments, the present disclosure is not limited to such embodiments, and additional modifications, applications, and embodiments may be implemented without departing from the present disclosure. In the figures, like reference numbers will be used to illustrate the same components. Those skilled in the art will recognize that the various components set forth herein may be altered without varying from the scope of the present disclosure.

Figure 1:
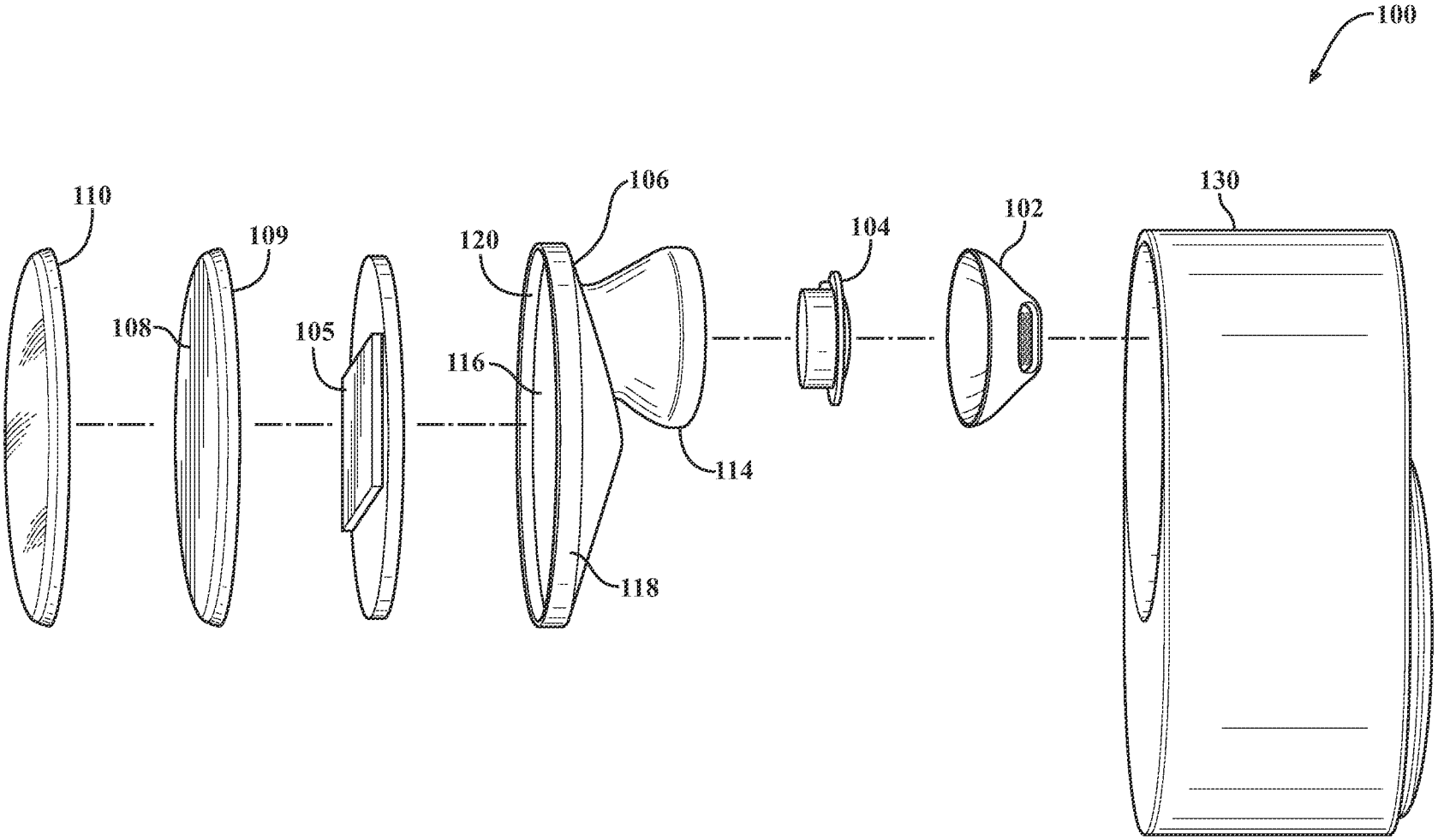
FIG. 1. Is an exploded view of an earbud and case.

FIG. 1 is an exploded view of an earbud 100 according to one or more embodiments that include a pair of earbuds that rest in a user's left and/or right ear to receive signals from a media source, for example a smart phone or tablet, (not shown) and send data, such as commands, to the media source. The earbud 100 includes an ear tip 102 that has a protrusion of a size and shape necessary to secure the earbud 100 into the user's ear canal. A sound driver 104 is connected to the ear tip 102 and the combination is housed in a housing 106 which is a structure that supports the ear tip 102, driver 104, a battery 105, a display 108 and a protective cover 110. On a first surface 112 of the housing 106, a protrusion 114 receives the driver 104 and mates with the ear tip 102 in a form that is received into the user's ear canal. A second surface 116 of the housing 106 is a support frame 118 for the battery 105, the display 108 and the protective cover 110. The driver 104 also includes a controller (not shown) in communication with the display 108.

An example configuration for a case 130 is also shown. The case 130 receives and stores a pair, left and right, earbuds 100. When stored in the case 130, the pair of earbuds may also be charged. In the example shown in FIG. 1, one earbud in the pair is shown in an exploded view and a second earbud in the pair of earbuds is shown stored in the case 130.

As discussed above, each earbud 100 has a battery 105. The battery 105 may be received into a recess 120 of the support frame 118. The display 108 has an outer perimeter curved edge 109 to conceal the support frame 118. The display has an outer perimeter that attaches to the support frame in a manner that allows the display to completely cover the battery. The outer perimeter curved edge 109 of the display 108 matches the outer perimeter of the support frame 118 in size and shape so that the curved edge of the display 108 completely conceals the support frame 118 from a front view of the ear bud. In the example shown in FIG. 1, the display and support frame are circular in shape and show circumferential perimeters for the display 108 and support frame 118. However, it should be noted that the circular shape is exemplary. It is possible that the display 108 and the support structure 118 may be other shapes, such as but not limited to, oval, square, hexagonal, rectangular, triangular, etc.

As discussed above, the battery 105 provides power to the earbud 100 for the driver 104 and display 108. The battery 105 is preferably rechargeable and may be received in the recess 120 of the support frame 118 as shown in FIG. 1. However, other configurations for the location and attachment of the battery 105 are possible without departing from the scope of the invention.

The display 108 is arranged on an outward-facing surface of the support structure 118 so that it is visible when the ear tip 102 is inserted in the user's ear. The display 108 may be a liquid crystal display (LCD). The display 108 may be a touch screen capable of receiving inputs based on a user touching the display 108 in a particular manner or by detecting gestures made by the user. The inputs received at the display 108 may be transmitted to a processor and/or controller, not shown, in the sound driver 104 and display 108 and transmitted wirelessly to and from the media source (not shown).

The display 108 may display graphics related to audio or media being listened to by the user such as a song title, artist name, album cover artwork, a video associated with the song, a static image, an image that moves or changes with the music, a video game score, a sports game score, etc. Additionally, or alternatively, the display 108 may display a color, image or video selected by the user. The color, image or video may be fixed, or it may change over time or in response to an input. The graphic to be displayed may be selected by the user or it may come in response to sensor data, such as a biometric sensor on the source, a weather report, a "mood" discerned from the genre of media being played by the source and heard at the earbud 100, etc. Additionally, or alternatively, the display 108 may display information about a status of the user, such as "Available", "Unavailable, "Listening to Music", "Do Not Disturb", "Leave a Message", or a message customized by the user, to name just a few examples. The touch screen on display 108 may also have the capability to control audio settings, such as volume, bass, treble, etc. Additionally, or alternatively, the touch screen on display 108 may also have the capability to receive and discern differences in gestures such as one, two or three fingers on the display, swiping, waving, tapping, etc. to control the media such as changing a volume, switching a song, answering a call, ending a call, etc.

Additionally, or alternatively, the display 108 may be controlled wirelessly by an application running on a user's mobile device or tablet, which may also be the media source (not shown). In this example, the user interacts with the application on the media source to control the display 108. This feature will be discussed in detail later herein.

Figure 2B:
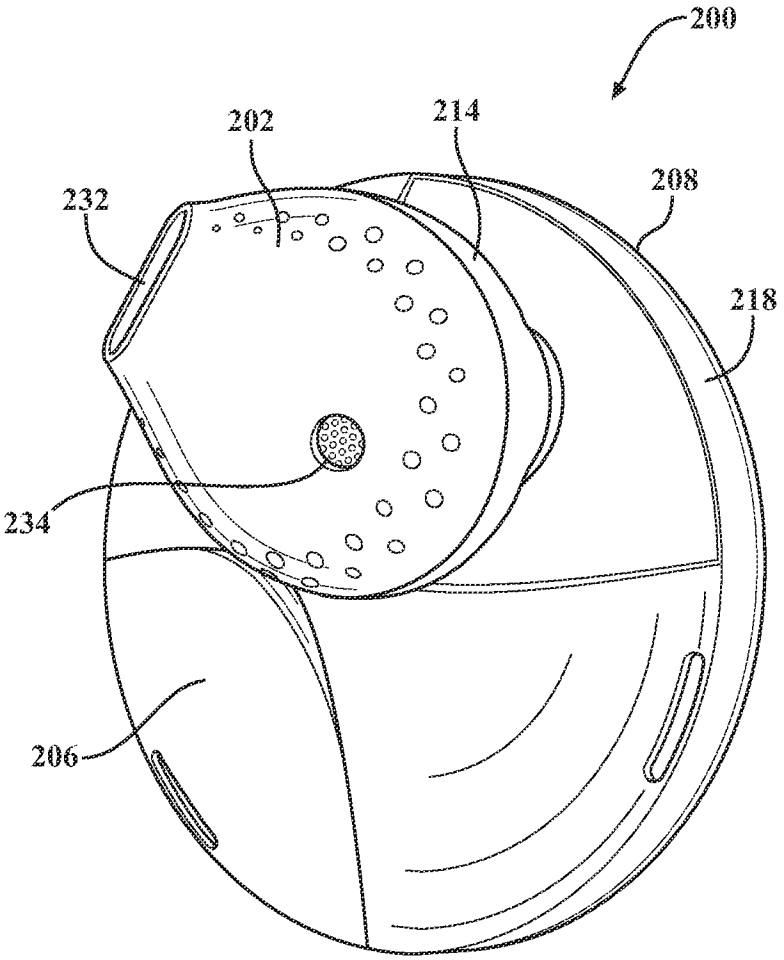
FIG. 2B is a rear perspective view of an earbud.
Figure 2A:
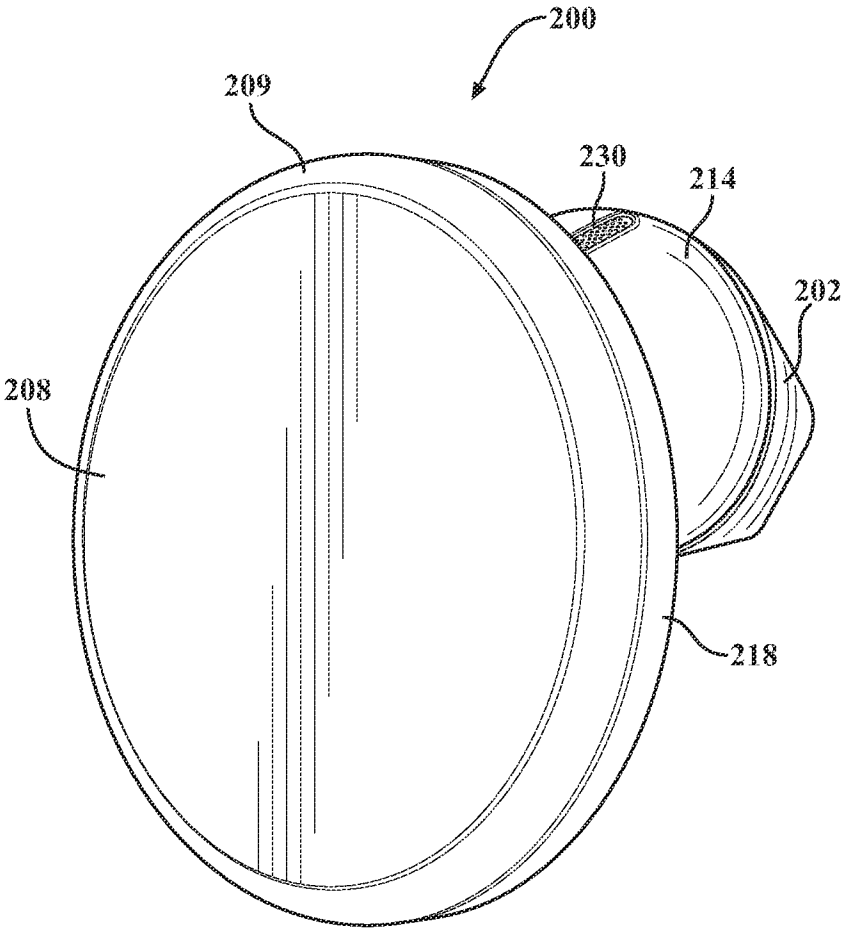
FIG. 2A is a front perspective view of an earbud.

FIG. 2A is a perspective front view of one or more embodiments of an earbud 200 showing the display 208 and the curved edge perimeter that conceals support structure 218. FIG. 2B is a rear perspective view showing a backside of the support structure 218. Ear tip 202 is also shown and includes a loudspeaker 230. Ear tip 202 is attached to, or extends from, the protrusion 214 of the housing 206. The ear tip 202 has a size and shape such that it may be comfortably received in the user's ear canal. For example, the ear tip 202 in FIG. 2B is tapered to improve retention in a concha of the ear for the user and to provide a pathway for an audio signal to be received by the user. The ear tip 202 includes vents, or openings, to the loudspeaker 230, one or more microphones 232, and other sensors 234, for example pressure and biometric sensors. It should be noted that the shape and structure of the ear tip 202 is only one example of many possible configurations.

FIG. 3A is a top view of earbud 300 which shows how the display 308 completely conceals the support structure (not visible) and housing (not visible) of the earbud 300. FIG. 3B is a bottom view showing the ear tip 302 and a first, or rear, surface of the housing 306 and the support structure 318. FIGS. 3C, 3D, 3E and 3F are side views showing the earbud 300 and detail of the display 308 having a perimeter edge 309 that matches, in size and shape, the support structure 318. The display 308 attaches to the support structure 318 in such a manner that it is outward facing and the perimeter edge 309 of the display 308 is flush with an edge of the support structure 318.

The display 308 may display any possible type of static or dynamic graphic information offering a user the ability to change the product appearance with unlimited options, and in real-time, to fit with any style, mood, external conditions, etc. Furthermore, because the user can customize the appearance of the product, the manufacturers are able to eliminate risk involved in attempting to predict color trends and are ale to focus more on product quality. The possibilities for customization services, and any updates, that may be provided to the user are limitless.

Figure 4:
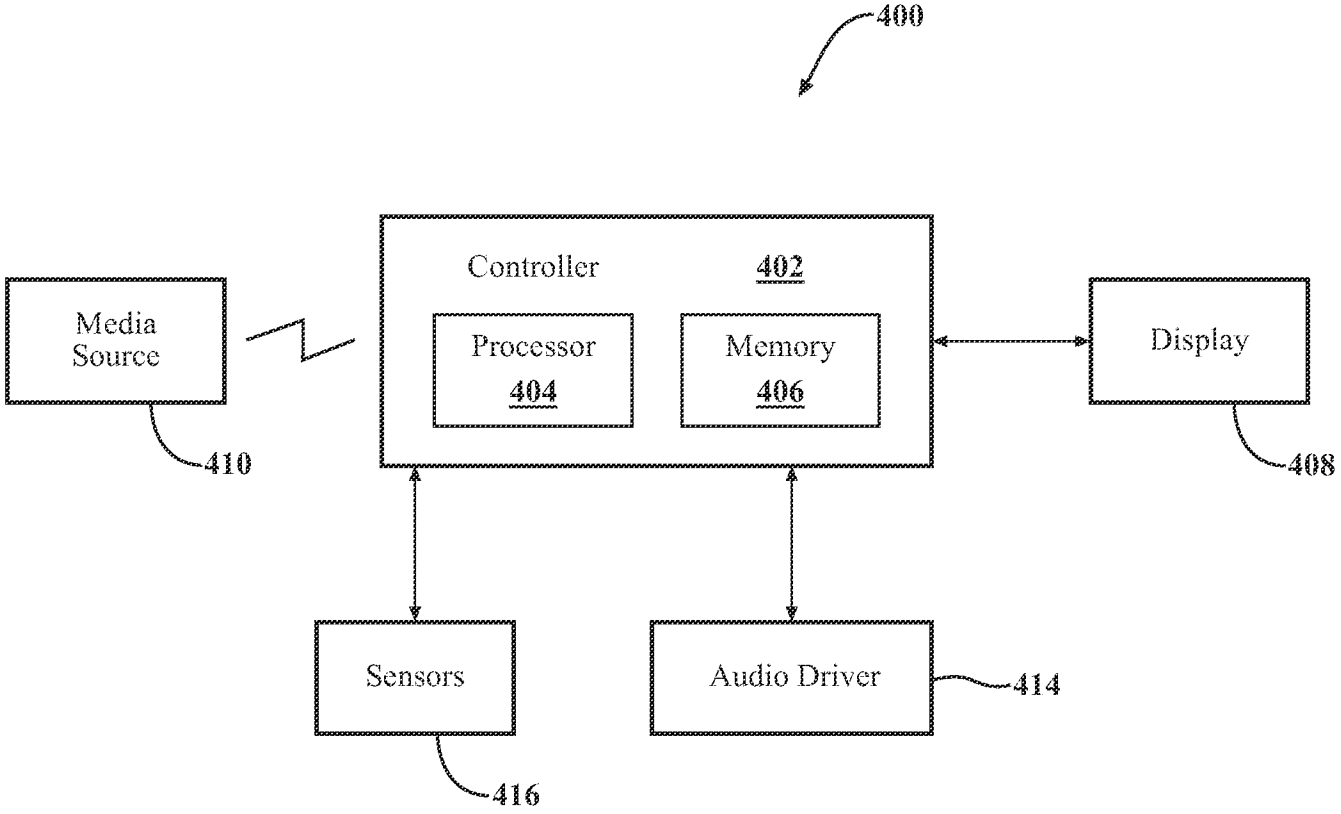
FIG. 4 a block diagram of a system for customizing an earbud.

FIG. 4 is a block diagram of a system 400 for displaying an image on an earbud having a display. A controller 402, including a processor 404 and memory 406, is in wireless communication with a media source 410. The memory 406 stores executable commands, or program code, that is executed by the processor 404. The media source 410 may be a mobile device such as a smart phone or a tablet, or a media player. The media source 410 is in wireless communication with the ear bud. The controller 402 receives audio signals from the media source 410 for playback by the audio driver 414. As discussed earlier, inputs for audio playback, phone calls (answering and/or ending), etc. may be communicated to the controller 402 by way of the media source 410 and an application running on the media source 410. The controller 402 also receives graphic content from the media source 410 to appear at the display 408. The content may be a static image, a dynamic image, a color, a pattern, a video, to name just a few examples.

The graphic content may be selected from an application that is running on the media source 410. Additionally, or alternatively, inputs may be communicated through the controller 402 by way of the display 408 using the touch screen or detecting user gestures to command the controller 402. Additionally, or alternatively, inputs may be communicated to the controller 402 by way of sensors 416, such as temperature sensors, pressure sensors, or biometric sensors, that may be part of the ear bud. The temperature and pressure sensors may sense conditions internal and external to the user. For example, sensing the temperature and pressure external to the user may indicate a certain weather conditions, which may translate to the graphic content being related to sunny or rainy weather and displayed as a particular color, image etc. to reflect the current weather. In another example, the type of music being played by the user may translate to the graphic content at the display being related to the artwork of an album cover, a music video, a photo of the artist, etc.

Figure 5:
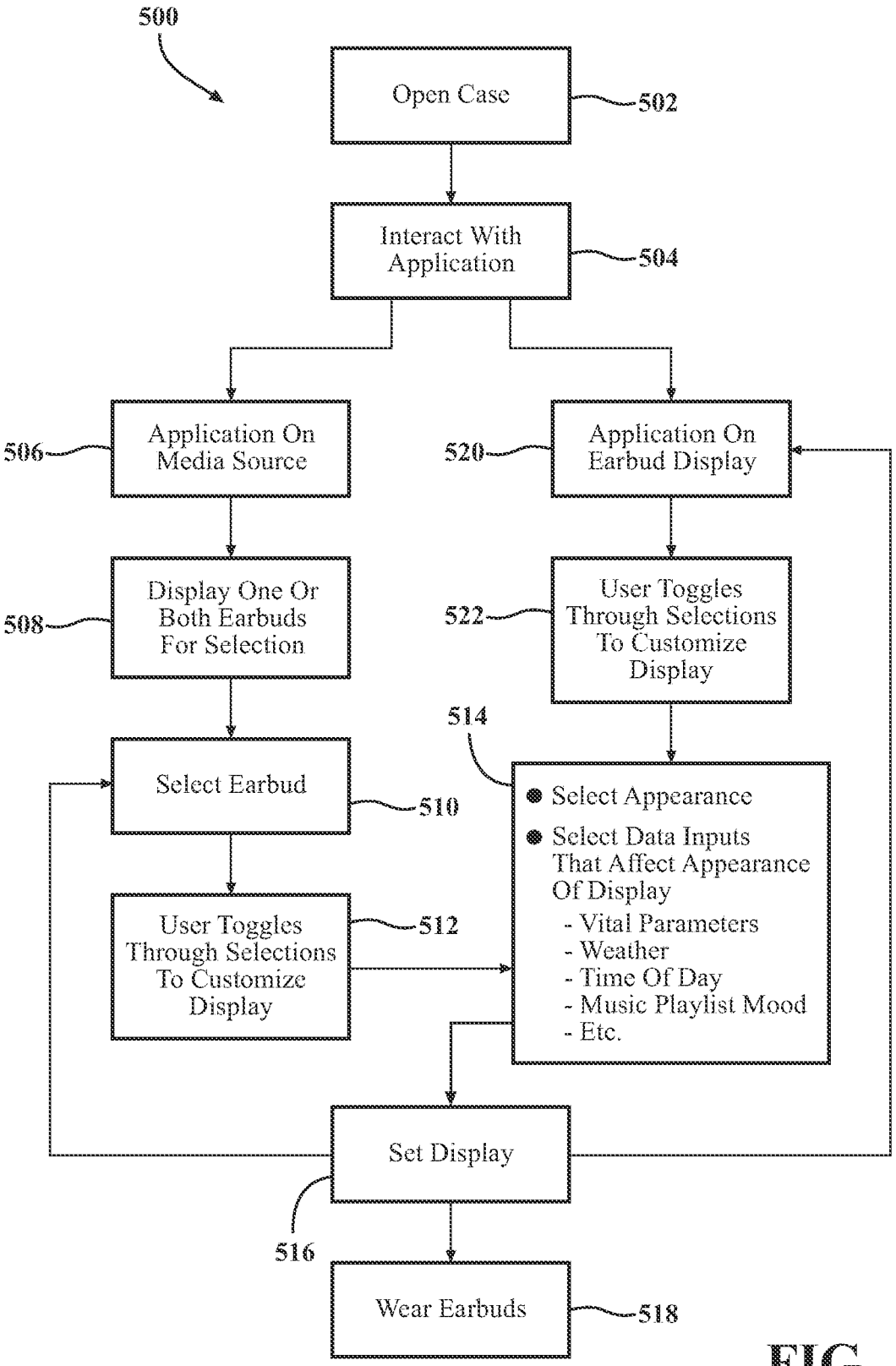
FIG. 5 is a flow chart of a method for customizing an earbud.

FIG. 5 is a flow diagram of a method 500 for user interaction to customize the earbud system. Computer readable program instructions from a computer readable storage medium are carried out by a processor, causing a series of operations or steps to be performed. At step 502, a user opens the case and removes one or more of the earbuds activating an application for customizing an appearance of the earbud display. At step 504, the user interacts with the application that customizes the appearance for the earbud display. At step 506, the user interacts with the application from a media source, such as a mobile device or tablet, that is in wireless communication with the processor on the earbuds. Alternatively, or additionally, at step 520 the user may interact with the application directly from the display on the earbud, in which instance the display is a touch screen display capable of detecting user inputs and gestures and capable of communicating the inputs and outputs to and from the processor.

Referring back to step 506 where the user interacts with the media source, the application running on the media source may display 508 a graphic of one, or both, of the earbuds for selection 510 by the user. Once the user selects the earbud to be customized, the user toggles 512 through selections available on the application. At step 514 the user customizes the display by selecting an available option for the appearance. Alternatively, or additionally, at step 514, the user may select data inputs that affect the appearance of the display. For example, vital parameters of the user that are sensed by sensors on the earbuds, weather conditions, a time of day, a music playlist, etc.

At step 516, the display is set to output the user's selection. At step 518, wears the earbuds with the customized display setting until which time the earbuds are returned to the case or a different appearance setting is selected by the user.

Referring again to step 520, the user may interact directly with the display on the earbud. As discussed above, the display may be a touch screen display wherein the user initiates gestures such as finger tapping, pinching, spreading, swiping, waving, etc. to interact with the display and to access options for selection to be communicated as inputs to the display. The user toggles 522 through available options that are possible to customize the display. At step 514, the user selects from the available options to customize the appearance. At step 516, the controller sets the display to display the appearance option selected by the user. At step 518, the user wears the earbuds having the customized appearance.

Each earbud has a display. The system has a first earbud having a first display and a second earbud having a second display. It should be noted that the appearance of each earbud may be customized on its own or as a pair. Specifically, the user may select a separate graphic for the first earbud than the second earbud, or they may be customized to match each other or be complementary to each other. The user may change the appearance of one, or both, in real-time to fit with any style or mood. Further, the manufacturer may provide updates that include new or improved customization options for the earbuds at any time over the life of the earbud.

In the foregoing specification, the present disclosure has been described with reference to specific exemplary embodiments. The specification and figures are illustrative, rather than restrictive, and modifications are intended to be included within the scope of the present disclosure. Accordingly, the scope of the present disclosure should be determined by the claims and their legal equivalents rather than by merely the examples described.

For example, the steps recited in any method or process claims may be executed in any order, may be executed repeatedly, and are not limited to the specific order presented in the claims. Additionally, the components and/or elements recited in any apparatus claims may be assembled or otherwise operationally configured in a variety of permutations and are accordingly not limited to the specific configuration recited in the claims. Any method or process described may be carried out by executing instructions with one or more devices, such as a processor or controller, memory (including non-transitory), sensors, network interfaces, antennas, switches, actuators to name just a few examples.

Benefits, other advantages, and solutions to problems have been described above regarding embodiments; however, any benefit, advantage, solution to problem or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials, or components used in the practice of the present disclosure, in addition to those not specifically recited, may be varied, or otherwise particularly adapted to specific environments, manufacturing specifications, design parameters or other operating requirements without departing from the general principles of the same.

What is claimed is:

1. An earbud, comprising:

a housing having a rear surface that is configured to be inserted into an ear canal of a user;

a driver in the housing, the driver is configured to output audio signals;

a controller in the housing;

a support structure on a front surface of the housing, the support structure has a predefined perimeter; and a display attached to the support structure on an outward facing surface of the support structure and receiving commands from the controller, the display has a curved edge having a perimeter that matches the predefined perimeter of the support structure, the curved edge of the display conceals the support structure of the housing making only the display visible.

2. The earbud of claim 1, wherein the controller is in wireless communication with a media source.

3. The earbud of claim 2, wherein the display is controlled by the controller from an application programming interface running on the media source, the display is controlled to customize content being displayed.

4. The earbud of claim 1, wherein the display is configured to receive inputs to control graphics presented, the inputs are:

a user touching the display to customize content being displayed; or a user making gestures that are detected by the display.

5. A customizable wearable system, comprising:

a first housing having a rear surface configured to be inserted into an ear canal of a user, the first housing has a first driver configured to output audio signals;

a support structure on a front surface of the first housing, the support structure has a perimeter having a predefined size and shape;

a first display screen attached to the support structure on an outward facing surface of the support structure, the first display screen has a curved edge having a perimeter that matches the predefined size and shape of the perimeter of the support structure, the curved edge of the first display screen conceals the support structure of the first housing; and a first controller in the first housing in communication with the first driver, the first display screen and a media source.

6. The system of claim 5, wherein the controller is in wireless communication with a media source.

7. The system of claim 6, wherein the first display is controlled by the controller from an application programming interface running on the media source, the first display is controlled to customize content being displayed.

8. The system of claim 5, wherein the first display is a touch screen display capable of receiving inputs to control graphics presented at the display based on a user touching the first display to customize content being displayed.

9. The system of claim 5, wherein the first display receives inputs to control graphics presented at the display by detecting gestures made by a user to customize content being displayed.

10. The system of claim 5, further comprising:

a second housing having a rear surface configured to be inserted into an ear canal of a user, the second housing has a second driver configured to output audio signals;

a support structure on a front surface of the second housing, the support structure has a perimeter with a predefined size and shape;

a second display screen attached to the support structure on an outward facing surface of the support structure, the second display screen has a curved edge having a perimeter that matches the predefined size and shape of the perimeter of the support structure, the curved edge of the second display screen conceals the support structure of the second housing; and the first controller in the first housing is in communication with the second driver, the second display screen, a second controller and the media source.

11. A method for setting an appearance of an earbud having a display attached to an outward facing surface of a support structure, the display has a curved edge having a perimeter that matches a perimeter of the support structure, the curved edge of the display screen conceals the support structure making only the display visible, the method carried out in a processor having computer executable instructions stored in non-volatile memory for performing the steps of:

toggling through a plurality of appearance options;

selecting an appearance option for the display from the plurality of appearance options; and displaying the selected appearance option at the display.

12. The method of claim 11, wherein the steps of toggling, selecting, and displaying are carried out by an application programming interface on a media device that is wirelessly communicating with the display.

13. The method of claim 11, wherein the earbud further comprises sensors capable of sensing vital parameters of a user and the step of selecting an appearance option for the display further comprises selecting an appearance option that displays the user's vital parameters.

14. The method of claim 11, further comprising a second earbud and the method further comprises selecting a different appearance option for the second earbud.

15. The method of claim 11, wherein the step of selecting an appearance option for the display may be performed in real time to modify the appearance option at the display.

* * * * *